US005139251A

United States Patent [19]

Ricciardi

[11] Patent Number: 5,139,251

[45] Date of Patent: Aug. 18, 1992

[54] DEFLECTOR DEVICE FOR DOCUMENT FEEDER

[75] Inventor: Mario Ricciardi, Glenview, Ill.

[73] Assignee: Bell & Howell Company, Skokie, Ill.

[21] Appl. No.: 724,846

[22] Filed: Jul. 2, 1991

[51] Int. Cl.[5] ..... B65H 3/04; B65H 3/34

[52] U.S. Cl. ..... 271/34; 271/104; 271/124

[58] Field of Search ..... 271/94, 34, 100, 101, 271/121, 123, 124, 132, 135, 137

[56] References Cited

U.S. PATENT DOCUMENTS 3,034,784 5/1962 Lopez ..... 271/104
3,219,339 11/1965 Gutierrez ..... 271/94
3,279,788 10/1966 Shields ..... 271/132
3,490,763 1/1970 Darwin ..... 271/132
3,907,278 9/1975 Jaton ..... 271/94
4,202,541 5/1980 Leskiw et al. ..... 271/132
4,208,009 6/1980 Markkanen et al. ..... 271/94
4,506,875 3/1986 Capdebosco et al. ..... 271/132
4,889,331 12/1989 Sardella ..... 271/94

*Primary Examiner*—Robert P. Olszewski
*Assistant Examiner*—Steven M. Reiss
*Attorney, Agent, or Firm*—Welsh & Katz

[57] ABSTRACT

A deflector plate is mounted adjacent a document feeder mechanism having feeder belts operative to engage successive documents supported in upstanding on-edge relation on a feed magazine so as to feed the documents in singulated fashion to a processing station downstream from the feeder mechanism. The deflector plate is angularly adjustable relative to the feed path of the feed magazine and is operative to deflect the trailing ends of documents being fed to the feeder belts so as to prevent each successive document from engaging the feeder belts prior to substantial discharge of the prior document from the feeder mechanism.

9 Claims, 2 Drawing Sheets

DEFLECTOR DEVICE FOR DOCUMENT FEEDER

BACKGROUND OF THE INVENTION

The present invention relates generally to document handling systems, such as mail sorting systems, and more particularly to a novel-deflector device for use in preventing feeding of more than one document at a time from a feeder station to which documents are fed on-edge by a document feed magazine.

Document handling systems are well known in which a plurality of documents, such as mailing envelopes and the like, are supported in stacked on-edge relation on a feed magazine and fed to a feeder station while disposed in generally vertical relation transverse to the feed path of the magazine. The feeder station may include a feeder mechanism having one or more feeder belts which define horizontal coplanar reaches engaged by the forward side of the lead document in the feed magazine. See, for example, U.S. Pat. No. 4,275,875 which is incorporated herein by reference. At lease one of the feeder belts may have one or more openings therethrough which pass a vacuum manifold as the openings traverse the document engaging reach so as to draw the lead document against the belt by suction and feed the document transversely from the feed magazine to a further processing station, such as a read station. The read station may include an optical character reader or bar code reader operative to read sorting indicia on each document, such as an alphanumeric address or bar code, which determines a subsequent sorting sequence.

One problem encountered with prior document handling systems of the aforementioned type is that the feeder mechanism may feed two or more documents simultaneously in side-by-side relation to the read station, or other document processing station immediately downstream from the feeder station. For example, in feeder mechanisms of the type employing a vacuum manifold and one or more horizontal feeder belt reaches operative to engage and feed the leading document from the feed magazine, the next successive document may engage the feeder belts before the leading document is substantially released from the feeder belts. If this occurs, the friction between the feeder belts and the next successive document may cause the second document to be advanced simultaneously with the lead document. Depending on the extend of document overlap, the read station may only read the sort indicia on one of the documents, thereby resulting in incorrect sorting or damage to the documents. As disclosed in U.S. Pat. No. 4,275,875, one manner of addressing this problem is to provide jogger arms which are positioned adjacent the horizontal feeder belt reaches and are actuated in timed relation to passage of the feeder belt suction holes along the vacuum manifold so as to push the whole stack of documents on the feed magazine away from the feeder belts just before the belt suction holes are interposed between the lead document and the vacuum manifold. Movement of the entire stack in this manner frees the leading document for easier separation from the remaining stack.

The present invention provides a further technique for addressing the aforedescribed problems encountered with vacuum beit type document feeders by providing a deflector device operative to deflect the trailing ends of documents being fed on a feed magazine so as to prevent engagement of each successive document with the feeder belts until the prior lead document has been substantially removed from the feeder belts, thereby preventing feeding of more than one document at a time from the feed magazine.

SUMMARY OF THE INVENTION

In carrying out the present invention, a deflector plate is mounted adjacent the feeder belts of a feeder mechanism which are operative to engage successive documents supported in upstanding on-edge stacked relation on a feed magazine and feed the documents transversely of the feed path to a processing station, such as a reader station or the like, downstream from the feeder station. The deflector plate is positioned to deflect the trailing ends of documents being fed to the feeder belts so that each successive document is prevented from engaging the feeder belts prior to substantial removal of the lead document from the feeder mechanism. In this manner, feeding of documents one-at-a-time from the feed magazine is greatly improved.

Accordingly, one of the primary objects of the present invention is to provide a novel deflector device for use in a document handling system having a belt feeder mechanism operative to feed successive documents from a feed magazine, the deflector device being operative to engage the trailing ends of successive documents being fed to the belt feeder mechanism so as to prevent the belt feeder from feeding multiple documents simultaneously from the feed magazine.

A more particular object of the present invention is to provide a novel deflector device for mounting adjacent a belt type document feeder mechanism having at least one horizontal feeder belt reach operative to engage the lead document in a stack of documents being fed to the feeder in upstanding on-edge relation, the deflector device including an adjustable deflector plate operative to engage the trailing ends of documents being fed to the feeder belt so as to prevent each successive document from engaging the feeder belt until the prior lead document has been substantially released from the feeder belt.

A feature of the deflector device in accordance with the invention lies in the employment of a deflector plate adapted to be pivotally mounted adjacent the belt feeder mechanism and having an adjustable leg enabling varying of the extent of deflection of the trailing ends of documents in relation to their relative thickness and flexibility.

Another feature of the deflector device in accordance with the invention lies in the provision of means biasing the deflector plate to a selected angular position as established by the adjustable leg.

Further objects, features and advantages of the present invention, together with the organization and manner of operation thereof, will become apparent from the following detailed description when taken in conjunction with the accompanying drawings wherein like reference numerals designate like elements throughout the several views.

BRIEF DESCRIPTION OF THE DRAWING(S)

DETAILED DESCRIPTION

Figure 1:
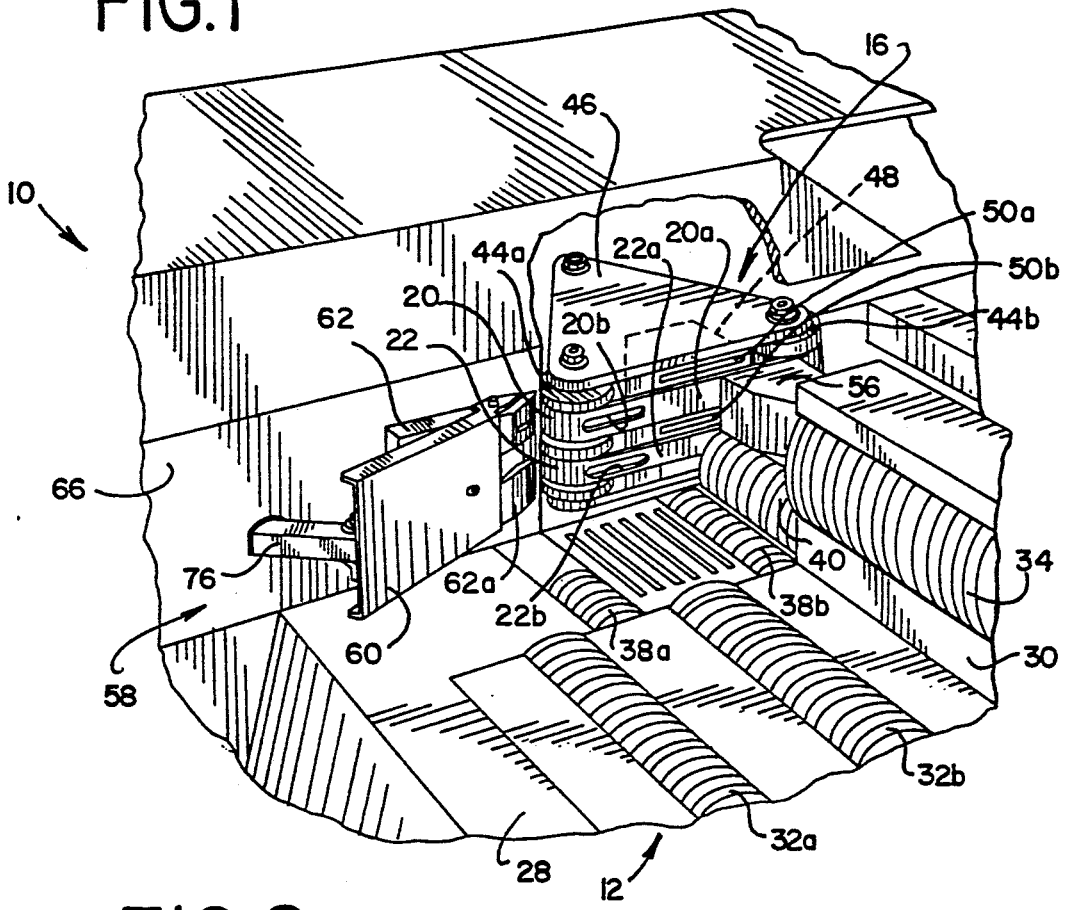
FIG. 1 is a fragmentary perspective view of a document handling system employing a document deflector device constructed in accordance with the present invention.
Figure 2:
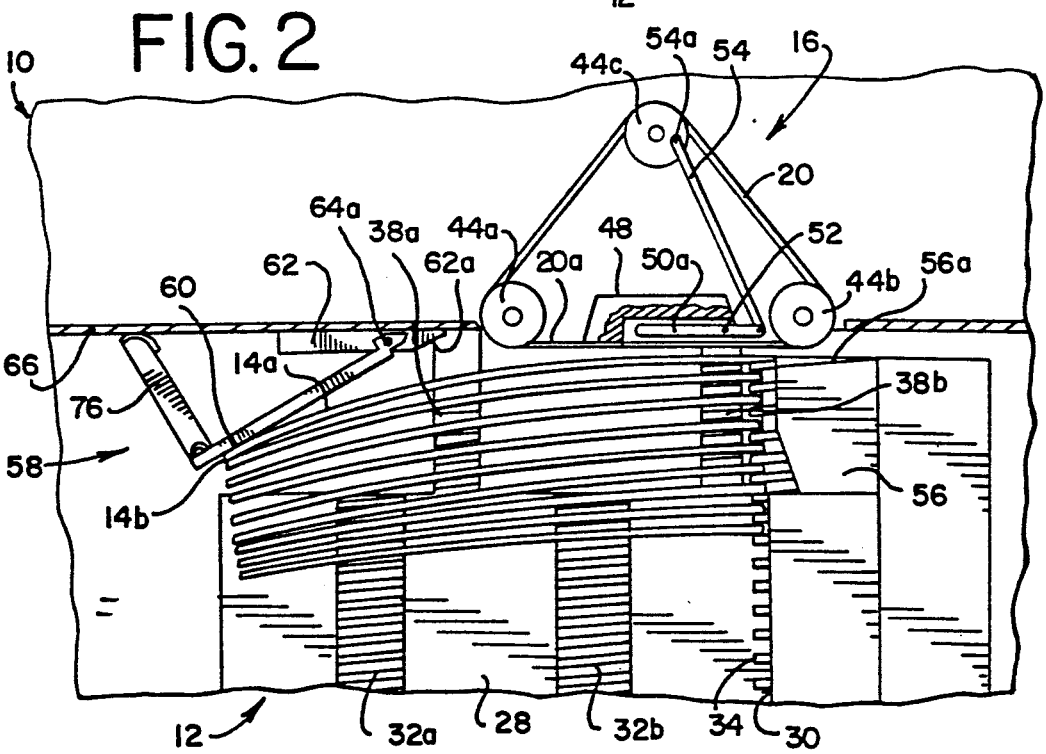
FIG. 2 is a fragmentary plan view of the document handling system of FIG. 1 but with portions broken away for purposes of clarity.

Referring now the drawings, and in particular to FIGS. 1 and 2, a document handling system employing a document deflector device in accordance with the present invention is indicated generally at 10. Briefly, the document handling system 10, which may alternatively be termed an envelope feeder system, includes a feed magazine, indicated generally at 12, which is operative to support a plurality of generally flat rectangular documents, such as mailing envelopes 14, in upstanding on-edge stacked relation and feed the documents progressively along a path toward a feeder mechanism, indicated generally at 16, while the documents are disposed substantially transverse to the feed path of the feed magazine. The feeder mechanism 16 is of generally known design, such as disclosed in the aforementioned U.S. Pat. No. 4,275,875, and includes a pair of endless feeder belts 20 and 22 having substantially horizontal spaced reaches 20*a* and 22*a*, respectively, which lie in a common vertical plane transverse to the feed path of the feed magazine. The reaches 20*a* and 22*a* of the feeder belts 20 and 22 are operative to engage the forward side or surface of each successive lead document 14 in the feed magazine 12 so as to move the documents generally transversely from the feed magazine path to a processing station, such as a reader station, downstream from the feeder mechanism. In so feeding the documents 14 from the feed magazine 12, each document establishes a leading end and a trailing end as it passes from the feeder mechanism 16.

Turning now to a more detailed description of the feed magazine 12 and the feeder mechanism 16, the feed magazine 12 includes a substantially horizontal low friction support plate 28 bounded along one edge by an upstanding right-angle guide plate 30 which extends parallel to the direction traversed by the documents 14 as they are fed toward the feeder mechanism 16. The guide plate 30 defines a low friction abutment surface to engage the upstanding leading edges of the documents as they are fed by the feed magazine. In the illustrated embodiment, a pair of substantially horizontal feed augers 32*a* and 32*b* are supported such that helical or spiral grooves formed in their outer peripheral surfaces are exposed above the surface of the support plate 28 sufficiently to receive the lower edges of the documents 14 and effect progressive feeding of the documents along a path substantially normal to the plane of the coplanar feeder belt reaches 20*a* and 22*a* of the feeder mechanism 16, as is known.

A third feed auger 34 is supported parallel to feed augers 32*a* and 32*b* and has a portion of its outer helically grooved peripheral surface exposed outwardly through a horizontal opening in the upstanding guide plate 30 spaced above the support plate 28, such as by approximately three inches. The helical feed grooves of the feed augers 32*a,b* and 34 may be of equal pitch along their lengths or may have variable pitch so that the pitch of the auger grooves closer to the feeder mechanism 16 is greater than the pitch of the augers farther from the feeder mechanism to initiate separation of the documents and relieve the pressure between the documents as they approach the feeder mechanism 16, as is known. In the illustrated embodiment, the helical feed grooves of augers 32*a*, 32*b* and 34 have constant pitch along their lengths and their forward ends terminate short of the feeder mechanism 16. Shorter length separator augers, such as indicated at 38*a* and 38*b*, are supported in parallel relation to augers 32*a,b* and have helically grooved feed surfaces extending above the support surface 28 to receive documents from the forward ends of augers 32*a,b*. A raised separator auger 40 is supported parallel to and spaced above the separator auger 34 to receive the leading vertical edges of the documents fed from the augers 32*a,b*.

The feed augers 32*a,b* and 34 are interconnected to suitable drive means (not shown) operative to rotate the augers 32*a,b* and 34 in a manner to advance documents toward the feeder mechanism 16. As the documents reach the forward ends of the augers 32*a,b* and 34, their lower horizontal and vertical leading edges are received by the separator augers 38*a,b* and 40 which are rotated at a greater rotational speed than augers 32*a,b* and 34 so as to effect separation of successive documents as they approach the feeder belt reaches 20*a* and 22*a*. The separator auger 38*a* preferably has a longitudinal length less than the lengths of the separator augers 38*b* and 40 so that the leading end of each successive document 14 is fed against the feeder belt reaches 20*a* and 22*a*, while the trailing end of the corresponding document exits from auger 38*a* and is free to bend or flex about a generally vertical axis approximately mid-length of the document without engaging the feeder belts 20 and 22, as illustrated in FIG. 2.

In the illustrated embodiment, the endless feeder belts 20 and 22 of the feeder mechanism 16 are supported so that their longitudinal axes lie in parallel planes. The feeder belts are supported by three annularly grooved support rollers 44*a*, 44*b* and 44*c* disposed between the support plate 28 and a triangular support plate 46 so that the three reaches of each feeder belt form sides of an isosceles triangle. Roller 44*c* is rotatably driven by drive means (not shown) so as to effect rectilinear movement of the feeder belts 20 and 22 in a known manner. The feeder belts 20 and 22 preferably have lengths greater than twice the horizontal lengths of the documents 14, which are generally approximately 5" min. – 11½ max. long for business and/or commercial type mailing envelopes.

Each of the feeder belts 20 and 22 has two elongated openings or slots therethrough, two of which are indicated at 20*b* and 22*b*, respectively, in FIG. 1. The openings in the feeder belts are of equal size, with the openings in each feeder belt being generally equally spaced from each other. The openings 20*b* in the upper belt 20 are generally vertically aligned with corresponding elongated openings 22*b* in the lower feeder belt 22 to establish sets of openings in the feeder belts. The openings 20*b* in the upper feeder belt 20 have their leading edges slightly advanced relative to the leading edges of the corresponding openings 22*b* in the lower feeder belt 22. As the feeder belts 20 and 22 are driven by the drive roller 44*c*, the slots 20*b* and 22*b* in the upper and lower feeder belts pass a vacuum manifold 48 having parallel elongated slots or openings (not shown) confronting the belt reaches 20*a* and 22*a*, respectively, so as to create a suction effect through the respective slots as they pass the vacuum manifold. The suction created as each set of slots 20b and 22b pass the vacuum manifold serves to suck the opposed forward surface of the lead document 14a from the separator augers 38b and 40 against the horizontal reaches 20a and 22a of the feeder belts and effect movement or feeding of the lead document in a direction transverse to the path of the feed magazine, as is known.

As the feeder belts 20 and 22 move the leading document, such as indicated at 14a in FIG. 2, from the feed magazine 12, progressively greater lengths of the horizontal belt reaches 20a and 22a are exposed rearwardly of the trailing edge of the leading document. One problem which may result with this arrangement is that the next successive document, such as indicated at 14b, behind the lead document may engage the exposed moving feeder belt reaches 20a and 22a before the lead document has released from the feeder belts. The feeder belts have relatively high friction outer surfaces which may cause the next successive document to be fed simultaneously with the lead document in at least partially overlapping relation therewith, thereby creating a multiple document or "double" feed from the feeder mechanism. This can result in multiple documents being fed simultaneously to a reader station and thereafter to a sort bin without proper singulating. The multiple fed documents may also be damaged as they are fed through the next downstream processing station which under normal circumstances is operative to process documents one-at-a-time from the feeder mechanism 16.

As aforementioned, one prior technique for separating the lead document from the remaining documents on a feed magazine so as to prevent feeding of multiple documents simultaneously by a vacuum feeder belt type feeder mechanism is to employ a pair of jogger or kicker arms, such as indicated at 50a and 50b in FIG. 1. In the illustrated embodiment, the jogger arms 50a,b are secured radially to a vertical pivot shaft 52 (FIG. 2) which is rotatably mounted on the vacuum manifold 48 so that the jogger arms may pivot in horizontal planes. A connecting arm 54 interconnects an end of the jogger arm 50a to an eccentric pivot axis 54a carried by and rotatably with the drive roller 44c so that the free ends of the jogger arms are pivoted forwardly of the plane of the feeder belt reaches 20a and 22a in timed relation to movement of the feed belts. Preferably, the jogger arms 50a,b are actuated to push or "kick" all of the documents 14 on the feed magazine away from the feeder belt reaches 20a and 20b just before each pair of suction openings 20b and 22b pass the vacuum openings in the vacuum manifold 48. Such movement of the entire stack of documents frees the leading document for easier return and separation from the remaining stack for feeding by the feeder belts.

To further assist in advancing documents individually from the feeder mechanism, a vacuum box 56 may be mounted at the forward end of the feed magazine 12 such that an inclined surface 56a on the vacuum box is opposed to and spaced a predetermined distance from the discharge ends of the feeder belt reaches 20 and 22a. The inclined surface 56a on the vacuum box 56 has a plurality of vacuum passages (not shown) which communicate with the interior of the vacuum box. A vacuum pump (not shown) is interconnected to the interior of the vacuum box 56 and is operative to establish a suction force at the inclined surface 56a which will not impede vacuum feeding of the lead document on the feed magazine by the feeder belts 20 and 22, but will act on the outermost documents of two or more documents being fed simultaneously by the feeder belts to retard movement of all but the lead document until the lead document has been discharged from the feeder belts. The vacuum box 56 and its operation are described in greater detail in U.S. Pat. No. 4,432,540 which is incorporated herein by reference.

In accordance with the present invention, and to further overcome the aforedescribed problem of feeding multiple-documents from the feeder mechanism 16, deflector means in the form of a deflector device, indicated generally 58, is supported adjacent the lead-in ends of the horizontal feeder belt reaches 20a and 22a of the feeder mechanism 16. The deflector device 58 is operative to engage the trailing ends of successive documents 14 being fed by the feed magazine 12 to the feed mechanism 16 so as to prevent each successive document from engaging the feeder belt reaches 20a and 22a until the prior lead document has been substantially removed from the feeder mechanism.

Figure 3:
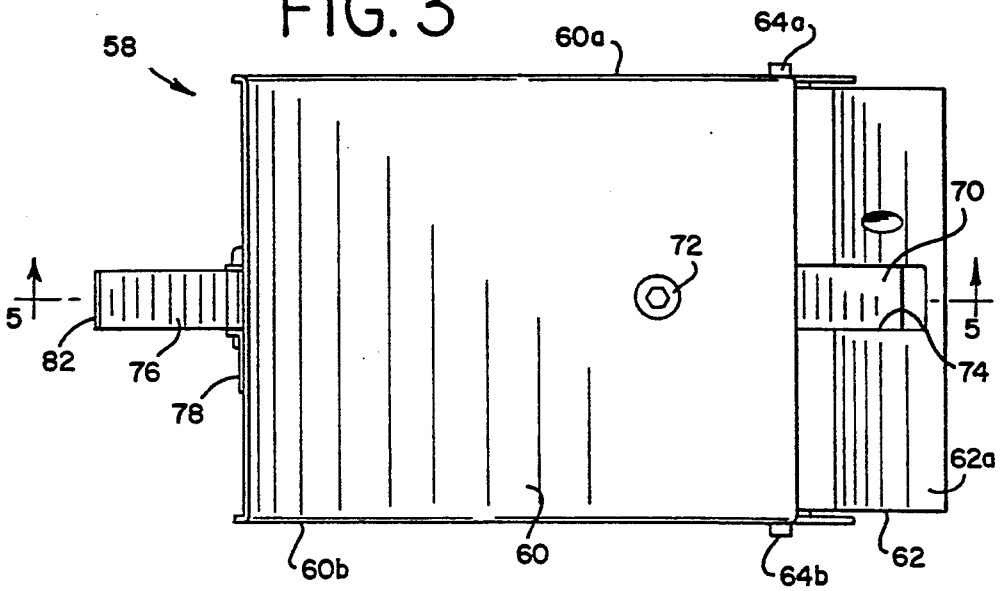
FIG. 3 is a front elevational view of the deflector device shown in FIG. 1.
Figure 4:
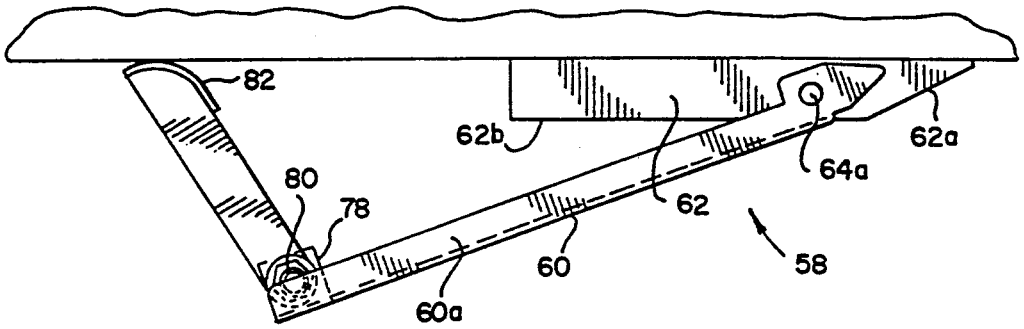
FIG. 4 is a plan view of the deflector device of FIG. 3.
Figure 5:
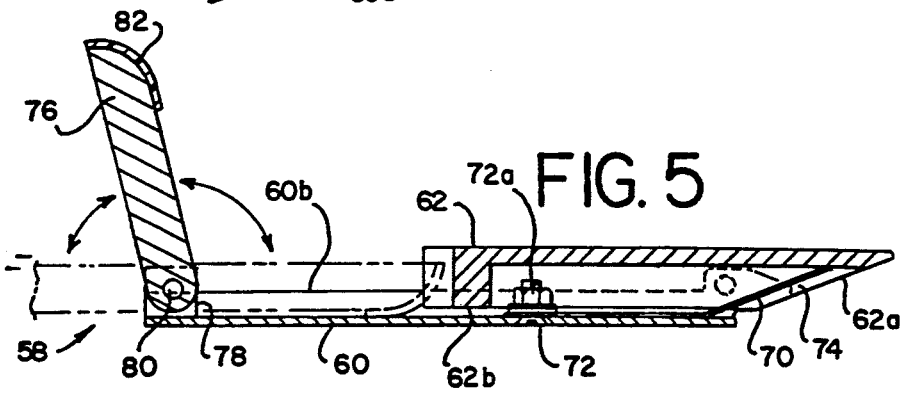
FIG. 5 is a longitudinal sectional view taken substantially along line 5—5 of FIG. 3.

Referring to FIGS. 3–5, taken in conjunction with FIGS. 1 and 2, the deflector device 58 includes a planar deflector plate 60 having right-angle flanges 60a and 60b formed along its upper and lower marginal edges. The deflector plate 60 is pivotally mounted at its forward end to a support bracket 62 through a pair of axially aligned pivot or stub shafts 64a and 64b. The support bracket 62 is mounted on a vertical frame plate 66 of the document handling system 10 adjacent the feeder mechanism 16 through suitable mounting screws or the like (not shown) such that the deflector plate 60 lies in a substantially vertical plane and is pivotal about the vertical pivot axis defined by the pivot shafts 64a,b. The mounting bracket 62 has an inclined surface 62a which forms an included angle of approximately 30–45° with the plane of the frame plate 66. The inclined surface 62a is formed to establish a generally contiguous deflector surface with the outwardly facing surface of deflector plate 60 during normal document deflecting operation of the deflector plate.

The deflector device 58 includes means biasing the deflector plate 60 to a collapsed position lying against an outer surface 62b of the mounting bracket 62. As illustrated in FIG. 5, the biasing means comprises a leaf spring 70 which is fixed at one end to the inner surface of the deflector plate 60 through a suitable screw 72 and nut 72a. The head of screw 72 is disposed within a counter-bore or recess formed in the outer surface of the deflector plate so that the screw head does not extend outwardly from the outer surface of the deflector plate. The opposite free end of leaf spring 70 is received within a generally rectangular channel 74 formed in the mounting bracket 62. The leaf spring 70 is configured to bias the deflector plate 60 against the outer surface 62b of the mounting bracket.

To facilitate selective angular positioning of the deflector plate 60 relative to the path traversed by the documents 14 in the feed magazine 12, the deflector plate carries an adjustable support leg 76. The support leg 76 is pivotally connected at one end to the inner surface of the deflector plate 60 adjacent its rearward end through a mounting flange 78 and connecting screw 80 which enable pivotal adjustment of leg 76 between a position lying against the inner surface of the deflector plate, as illustrated in phantom in FIG. 5, and a selected outwardly extending position such as shown in solid lines in FIG. 5. The outer end of the support leg 76 carries a friction pad 82 for engaging the frame plate 66 to maintain the deflector plate 60 in selected angular relation to the frame plate. The pivotal connection of the support leg 76 to the deflector plate 60 is sufficiently snug to maintain the support leg in the selected angular position relative to the deflector plate.

The deflector plate 60 may thus be adjusted relative to the frame plate 66 so that, in the illustrated embodiment, a deflector angle of up to approximately 45° degrees can be established between the deflector plate 60 and the document feed path defined by the feed magazine 12. With the deflector plate 60 angularly adjusted relative to the document path of the feed magazine 12, the trailing ends of successive documents 14 on the feed magazine will engage the deflector plate and be deflected or flexed from planes substantially transverse to the document feed path. This maintains the trailing end of each successive document spaced from the feeder belt reaches 20*a* and 22*a* until the leading end of the corresponding document is drawn against the feeder belts by the suction action of the vacuum manifold 48 as the sets of openings 20*b*, 22*b* in the feeder belts pass the vacuum manifold. At this point, the prior lead document has been substantially advanced from the feeder mechanism 16. The pivotal support leg 76 allows the deflector plate 60 to be selectively angularly adjusted relative to the document feed path of the feed magazine 12 depending on the relative flexibility of the documents being fed by the feed magazine.

While a preferred embodiment of the present invention has been illustrated and described, it will be understood to those skilled in the art that changes and modifications may be made therein without departing from the invention and its broader aspects. Various features of the invention are defined in the following claims.

What is claimed is:

1. In a document feeder system including a feed magazine operative to support a plurality of generally flat documents on edge and feed the documents along a feed path while disposed substantially transverse to the path, and a feeder mechanism including at least one feeder belt having a reach operative to engage the forward sides of successive lead documents in the feed magazine and move said documents generally transversely of said feed path so as to establish leading and trailing ends of the documents; the combination therewith comprising deflector means including a deflector plate supported generally adjacent said feeder belt reach and operative to engage the trailing ends of successive documents fed by said feed magazine so as to prevent each successive document from engaging said feeder belt reach until the prior document has been substantially removed from the feeder mechanism, and means biasing said deflector plate toward a position lying in a plane substantially transverse to the feed path of said feed magazine.

2. A method for preventing feeding of multiple documents simultaneously from a document feeder mechanism having at least one feeder belt operative to engage successive leading documents in a stack of documents fed to the feeder mechanism while disposed in upstanding on-edge side-by-side relation, the feeder belt being operative to feed successive leading documents from the stack in a direction generally transverse to the document feed path so as to establish document leading and trailing ends; said method comprising deflecting the trailing ends of successive documents in the stack away from the feeder belt by engaging the trailing end of each successive document with a deflector plate so as to prevent engagement of each successive document with the feeder belt until the preceding document has been substantially disengaged from said feeder belt, said deflector plate having an adjustable leg enabling variation in angular relation of the deflector plate to the feed path of the documents, said step of deflecting the trailing ends of successive documents comprising adjusting the extent of deflection of said trailing ends of said documents in relation to the relative flexibility of said documents by selectively adjusting said adjustable leg relative to said deflector plate.

3. In a document feeder system including a feed magazine operative to support a plurality of generally flat documents on edge and feed the documents along a feed path while disposed substantially transverse to the path, and a feeder mechanism including at least one feeder belt having a reach operative to engage the forward sides of successive lead documents in the feed magazine and move said documents generally transversely of said feed path so as to establish leading and trailing ends of the documents; the combination therewith comprising deflector means including a deflector plate supported in a substantially vertical plane generally adjacent said feeder belt reach and operative to engage the trailing ends of successive documents fed by said feed magazine so as to prevent each successive document from engaging said feeder belt reach until the prior document has been substantially removed from the feeder mechanism, said deflector plate being supported for pivotal movement about a substantially vertical axis so as to enable adjustment of the angular relation of said deflector plate relative to the feed path of said feed magazine.

4. A document feeder system as defined in claim 3 wherein said deflector means further includes a support leg operatively associated with said deflector plate and selectively positionable to vary the angular relation of said deflector plate relative to the feed path of said feed magazine.

5. A document feeder system as defined in claim 4 wherein said support leg is pivotally mounted on said deflector plate and is adjustable to selectively vary the angle of inclination of said deflector plate relative to the feed path of said feed magazine.

6. A document feeder system as defined in claim 5 wherein said support leg includes a friction pad carried on an outer free end thereof.

7. In a document feeder system including a feed magazine operative to support a plurality of generally flat documents on edge and feed the documents along a feed path while disposed substantially transverse to the path, and a feeder mechanism including at least one feeder belt having a reach operative to engage the forward sides of successive lead documents in the feed magazine and move said documents generally transversely of said feed path so as to establish leading and trailing ends of the documents; the combination therewith comprising deflector means including a deflector plate supported generally adjacent said feeder belt reach and operative to engage the trailing ends of successive documents fed by said feed magazine so as to prevent each successive document from engaging said feeder belt reach until the prior document has been substantially removed from the feeder mechanism, said deflector means including a support bracket to which said deflector plate is pivotally mounted, said support bracket having an angled leading surface substantially contiguous to a forward edge of said deflector plate.

8. A document feeder system as defined in claim 7 including biasing means cooperative with said deflector plate and said support bracket in a manner to bias said deflector plate to a position substantially transverse to the feed path defined by the feed magazine, said deflector plate being angularly adjustable against the action of said biasing means.

9. A document feeder system as defined in claim 8 wherein said biasing means comprises a leaf spring connected at one end to a selected one of said deflector plate or support bracket, the opposite end of said leaf spring being cooperative with the other of said deflector plate or support bracket in a manner to urge said deflector plate to a position substantially transverse to the feed path defined by the feed magazine.

* * * * *